US005516051A

United States Patent [19]

Brisbois et al.

[11] Patent Number: 5,516,051

[45] Date of Patent: May 14, 1996

[54] LIFTING ELEMENT FOR ROTARY MILL AND MILL EQUIPPED WITH SUCH ELEMENTS

[75] Inventors: Jean-Marie Brisbois, Dion-le-Mont; Serge Rycerski, Olne, both of Belgium

[73] Assignee: Magotteaux International, Vaux-Sous-Chevremont, Belgium

[21] Appl. No.: 306,699

[22] Filed: Sep. 15, 1994

[30] Foreign Application Priority Data

Sep. 17, 1993 [LU] Luxembourg ..... 88 409

[51] Int. Cl.[6] ..... B02C 17/00; B02C 17/22

[52] U.S. Cl. ..... 241/172; 241/183; 241/299; 241/DIG. 30

[58] Field of Search ..... 241/183, 174, 241/DIG. 30, 172, 299

[56] References Cited

U.S. PATENT DOCUMENTS

| | | | |
|---|---|---|---|
| 1,539,237 | 5/1925 | Borcherdt | 241/183 X |
| 2,809,789 | 10/1957 | Roubal | 241/183 |
| 2,876,957 | 3/1959 | Fobelets | 241/183 |
| 2,949,247 | 8/1960 | Rosenqvist et al. | 241/183 |
| 4,289,279 | 9/1981 | Brandt | 241/102 |
| 4,402,465 | 9/1983 | Persson et al. | 241/183 |
| 5,431,351 | 7/1995 | Lejonklou | 241/183 |
| 5,472,148 | 12/1995 | Schaeffer | 241/183 |

FOREIGN PATENT DOCUMENTS

| | | | |
|---|---|---|---|
| 0022758 | 1/1981 | European Pat. Off. | 241/183 |

*Primary Examiner*—John Husar
*Attorney, Agent, or Firm*—Schmeiser, Olsen & Watts

[57] ABSTRACT

The lifting element (16) consists of a parallelepipedal block of elastomer designed to be fixed to the internal wall of a grinding mill and forms part of the lining of the latter. Its face (24) exposed to the grinding elements includes cavities (26) to allow the grinding elements to be embedded therein.

16 Claims, 2 Drawing Sheets

FIG. 2
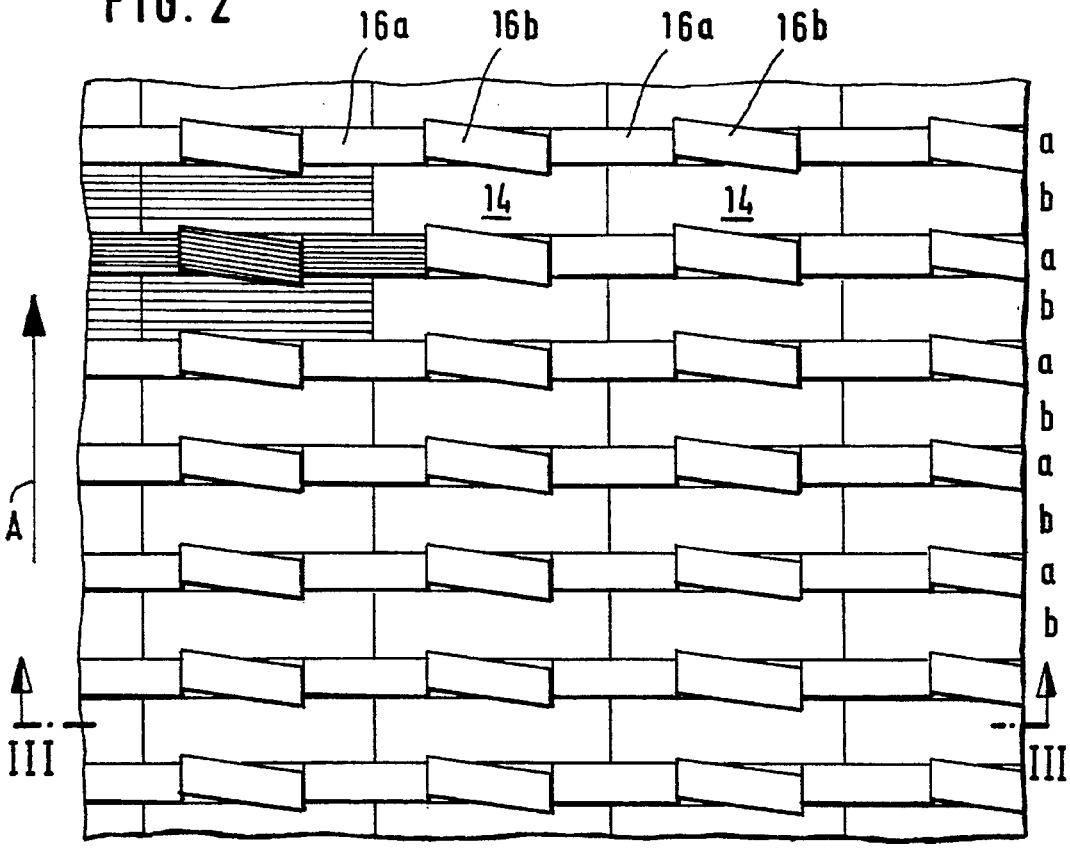
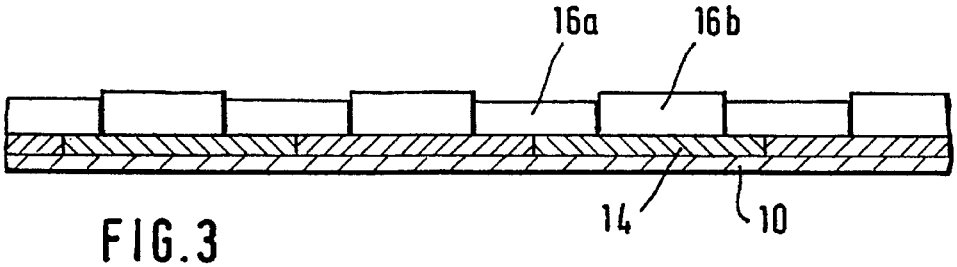
FIG. 3

LIFTING ELEMENT FOR ROTARY MILL AND MILL EQUIPPED WITH SUCH ELEMENTS

BACKGROUND OF THE INVENTION

The present invention relates to a lifting element for a rotary mill consisting of a parallelepipedal block of elastomer designed to be fixed to the internal wall of a rotary grinder containing grinding implements and to form part of the lining of the latter. The invention also relates to a rotary mill comprising a cylindrical shell the internal lining of which includes such lifters.

The invention more particularly relates to the field of mills which are run wet, particularly those used in cement making or in the mining industry for crushing and grinding minerals. These mills consist of a cylindrical shell rotating about its longitudinal axis and containing a grinding charge consisting of grinding implements such as balls, cylpebs, boulpebs, etc. of different sizes.

The shell includes an internal lining consisting of lining plates and of what are called lifting elements or lifters having the function of mixing and entraining the grinding charge and the material to be ground. The latter is introduced on one side of the mill and, as it progresses towards the outlet, on the opposite side, it is ground and crushed between the grinding implements.

Given that the grinding takes place progressively in the direction of throughput through the mill, the best grinding conditions are achieved when the size of the grinding implements is matched to that of the material to be ground. In other words, the coarsest grinding implements should, preferably, be concentrated on the inlet side of the mill, whereas the smallest ones should be located on the outlet side. This is what is known as the classification of the grinding implements as a function of their size. Under optimum conditions, this classification should therefore be achieved automatically during the operation of the mill.

Moreover, in the interest of effectiveness of the grinding and the durability of the grinding implements, it is necessary, as far as possible, to avoid projections and drops of the latter in favour of intense sliding and intense mixing, which are favourable to the crushing and grinding of the material between the moving grinding implements.

To date, the linings of the mills running wet were either made from cast iron or from alloy steels, or from elastomer. The linings made from cast iron or alloy steels have the drawback of a high weight and time-consuming manipulation when installing the elements forming the lining. Furthermore, they are extremely noisy and no longer respond to the ever increasingly severe environment criteria.

To resist wear, the elastomer linings had lifting elements which were bigger than those of the metallic linings. These thicker and more projecting elements still tend to project the grinding bodies when the mill rotates. Now, the projection of the grinding implements reduces the effectiveness of the grinding and accelerates the wear of the grinding implements by cracking and micro-splintering.

Furthermore, it has been noted that thick and projecting elastomer lifting elements tend to give rise to a longitudinal segregation of the grinding implements which is contrary to the envisaged classification, so that the small grinding implements are often found at the inlet to the mill and the coarser ones are often found on the outlet side, whereas, for effective grinding, it is the contrary which is envisaged.

SUMMARY OF THE INVENTION

The object of the present invention is to provide a novel elastomer lifting element which is less exposed to wear, as well as a mill in which these novel elements are arranged so as to ensure the desired classification of the grinding implements and to improve the effectiveness of the grinding.

To reach this objective, the lifting element proposed by the present invention is characterized in that at least a part of its face exposed to the grinding implements includes cavities to allow the grinding implements to be embedded therein.

The grinding implements which thus embed, during the grinding operation, in the lifting elements, in general remain caught up therein under the effect of the elasticity of the elastomer.

By virtue of the embedding of the grinding implements in the lifting elements, their resistance to wear is increased, which makes it possible to reduce their thickness as well as the risks of projection for the grinding implements, finally to improve the effectiveness of the grinding force.

The invention also envisages a grinder equipped with such lifting elements and in which these elements and the lining plates are arranged in alternating longitudinal rows.

According to a preferred embodiment, each row of lifting elements includes, over at least part of the length of the shell, straight elements parallel to the generatrix of the shell and elements which are inclined with respect to the generatrix of the shell. Each straight element is preferably surrounded by two inclined elements, and vice-versa.

It has been noticed that this alternating combination of straight elements and of inclined elements promotes the classification of the grinding implements over the length of the mill in the desired sense, that is to say that the most voluminous grinding implements remain at the inlet of the mill and the smallest ones are pushed back towards the outlet, where the material to be ground is finer.

According to another aspect of the invention, the straight elements and the inclined elements have different radial thicknesses. By virtue of this design, relative sliding and movements are brought about between the various layers of the grinding charge and of the material to be ground, in the diametral planes of the mill.

BRIEF DESCRIPTION OF THE DRAWINGS

Other particularities and features of the invention will emerge from a preferred embodiment, presented hereafter, by way of illustration, with reference to the appended drawings in which:

FIG. 2 shows a front view of a part of the lining of a mill and

FIG. 3 represents a longitudinal section along the section plane III—III in FIG. 2.

DESCRIPTION OF THE PREFERRED EMBODIMENT(S)

Figure 1:
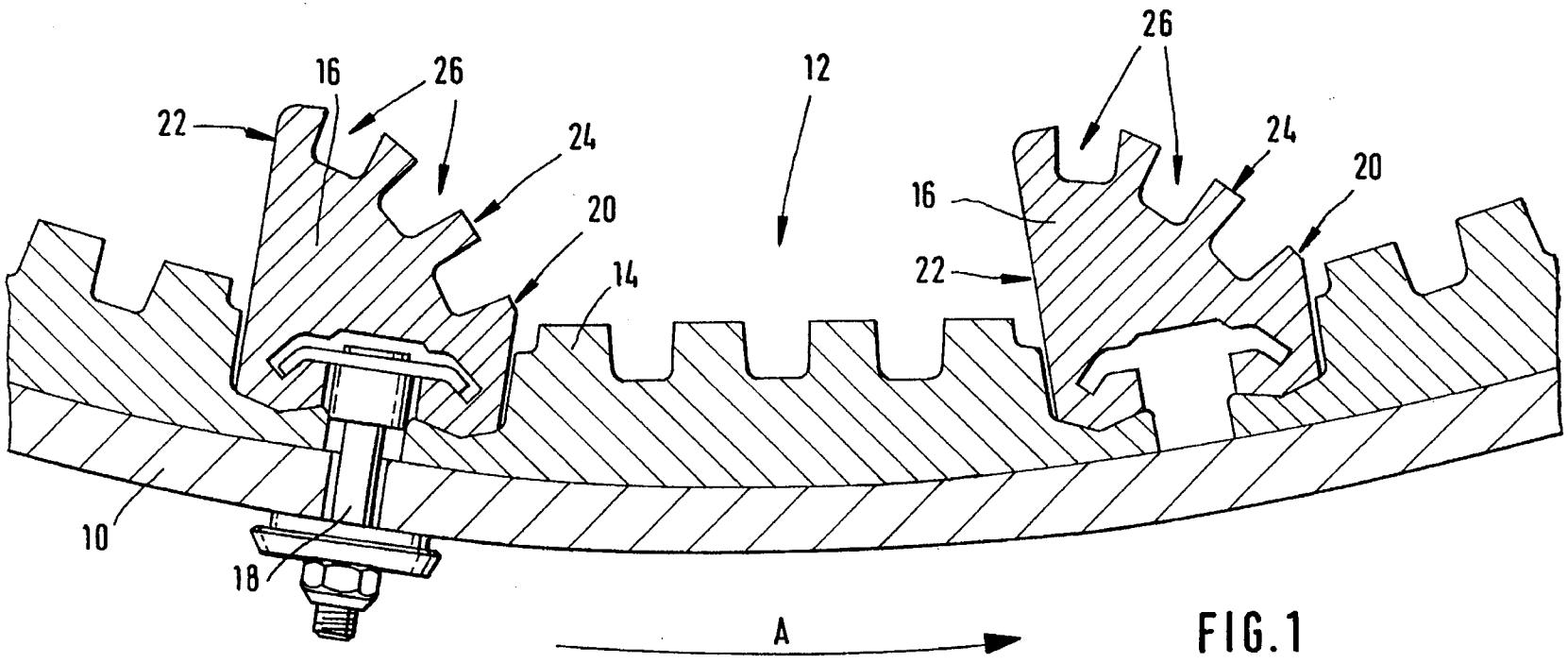
FIG. 1 shows part of a view in diametral section of a mill according to the present invention.

The reference 10 in FIG. 1 represents a metallic cylindrical shell of a mill with an internal coating forming a lining 12 for protecting the shell 10. This lining consists of lining plates 14 as well as lifting elements 16 fixed with the aid of suitable bolts 18 onto the shell. In the example represented, the lining plates 14 are not fixed directly to the shell 10 but are held in place by virtue of the fixings of the neighbouring lifting elements 16.

The shell 10 is designed to be entrained rotationally about its longitudinal axis in the direction of the arrow A. During this rotation, the function of the lifting elements 16, the radial thickness of which is greater-than that of the lining plates 14, is to entrain the grinding charge and the material to be ground, which is not shown. Given that the mill is only partially filled, generally of the order of 30% full, the grinding charge and the material to be ground both accumulate, when the mill rotates, essentially in the fourth trigonometrical quarter of the mill viewed in the axial direction of FIG. 1. After this mass has wound around itself and following the relative sliding between the various layers, the material is progressively ground by the grinding charge gradually as it progresses from the inlet to the outlet of the mill.

The lifting elements 16 are parallelepipedal blocks made from elastomer, for example of rubber, fixed in longitudinal rows onto the wall of the shell 10. The radial side 20 of each lifting element 16 in its zone for attacking the grinding charge, viewed in the direction of rotation A, is less deep than the opposite radial side 22 so that the face 24 which is exposed to the charge and which connects the sides 20 and 22 is oblique with respect to the shell. This face 24 may be straight or slightly domed as represented in FIG. 1.

In accordance with the present invention, the face 24 of each lifting element 16 includes a series of cavities 26. The latter may be distributed evenly or randomly over the entire length of the lifting elements, the essential point being that the grinding implements can embed therein during the operation of the mill in order to improve the resistance of the lifting elements 16 to wear.

The size of the lifting elements 16 is variable depending on the dimensions of the mill. In a mill having, for example, the following data:

length: 12 meters, diameter: 2.2 meters, speed: 19.8 revs/minute, coefficient of filling: 28%, grinding implements: 100 to 600 grammes.

Lifters with the following dimensions have been provided:

length: 700 mm, width: 100 mm, thickness (maximum height of the side 22): 115 mm The dimensions of the lifting elements are generally larger if the coefficient of filling of the mill is greater or if the mill rotates more slowly.

The lining plates 14 may be made of elastomer, either of the type with cavities for embedding, or with a surface roughness.

According to another aspect of the invention, the lifters are arranged with a specific layout contributing to a greater effectiveness of the grinding. In effect, as shown in FIG. 2, the lifting elements are arranged in longitudinal rows a which alternate with longitudinal rows b of lining plates.

Moreover, each row a of lifting elements includes, according to a preferred embodiment, a series of straight elements **16*a*, that is to say ones which are parallel to the generatrix of the mill, and a series of elements 16*b* which are inclined with respect to the generatrix of the mill. The arrangement and the layout of the straight elements 16*a* and of the inclined elements 16*b*** can be changed over the length of the mill depending on the operating conditions of the mill, particularly as regards the rotational speed, the coefficient of filling, and the diameter of the mill.

In the example represented, each row a of lifting elements includes an alternating succession of straight elements and of inclined elements. It is preferable to provide, in the inlet zone of the mill, which is not represented in the figure but which is located on the left-hand side of the latter, only straight elements.

It has proved to be the case that the alternation of straight elements and inclined elements has a favourable influence on the classification of the grinding implements by pushing the coarsest ones towards the inlet zone and the smallest ones towards the outlet zone of the mill.

In the example of FIG. 2, the lifting elements **16*b*** are inclined in the direction of the outlet of the mill, which is located on the right-hand side of the figure. However, both the direction and the angle of inclination of the lifting elements may be changed as a function of the nature and of the form of the grinding implements in order to obtain the best classification effect.

As shown in FIG. 3, the straight lifting elements **16*a* and the inclined lifting elements 16*b* do not have the same thickness. In the example represented, the inclined elements 16*b* are thicker than the straight elements 16*a***, but the contrary is equally possible. The object of this design is to give rise, as the mill rotates, in diametral planes, to shearing between various layers of the grinding charge and of the material to be ground.

It is possible, taking away the differences in thickness between the lifting elements and the lining plates, for the level of the lining to be uniform from the inlet as far as the outlet of the mill. It is, however, equally possible for the level of the lining, at the outlet, to be slightly higher than at the inlet so that the cross-section of the mill is slightly convergent towards the outlet.

We claim:

1. Lifting element for a rotary mill having grinding implements comprising:

a parallelepipedal block of elastomer designed to be fixed to an internal wall of said rotary mill to form part of the lining of the internal wall, wherein a face of the lifting element is exposed to the grinding implements, said face including cavities with elastomeric walls, said cavities facing away from said internal wall and shaped to embed and retain the grinding implements therein under the effect of the elasticity of the elastomer, whereby said grinding implements remain in said cavities when said rotary mill is both rotating and stationary.

2. Lifting element as claimed in claim 1, wherein the face including the said cavities is inclined with respect to the wall of the mill, the thickness of the side of an attack zone, viewed in the direction of rotation of the mill, being less than on the opposite side.

3. Lifting element as claimed in claim 2, wherein the said face is domed when viewed in a diametral section of the mill.

4. Rotary mill comprising a cylindrical shell with an internal lining comprising:

lifting elements and lining plates, wherein each of said lifting elements comprises a face exposed to grinding implements contained in the rotary mill, said face including cavities with elastomeric walls, said cavities facing away from said internal wall to embed and retain the grinding implements therein under the effect of the elasticity of the elastomer, whereby said grinding implements remain in said cavities when said rotary mill is both rotating and stationary.

5. Mill as claimed in claim 4, wherein the lifting elements and the lining plates are arranged in alternating longitudinal rows.

6. Mill as claimed in claim 5, wherein each row of the lifting elements includes, over at least part of the length of the shell, straight elements parallel to the generatrix of the shell and elements which are inclined with respect to the generatrix of the shell.

7. Mill as claimed in claim 6, wherein each straight element is surrounded by two inclined elements and vice-versa.

8. Mill as claimed in claim 6, wherein the straight elements and the inclined elements have different radial thicknesses.

9. Mill as claimed in claim 4, wherein the thickness of the lining is constant over the entire length of the mill.

10. Mill as claimed in claim 4, wherein the thickness of the lining is higher at the outlet than at the inlet.

11. The mill as claimed in claim 4, wherein said lining plates comprise a face exposed to said grinding implements, said face of said lining plates including cavities to embed and retain said grinding implements therein.

12. Rotary mill comprising a cylindrical shell with an internal lining comprising:

lifting elements and lining plates arranged in alternating longitudinal rows, wherein each row of the lifting elements includes, over at least part of a length of the shell, straight elements parallel to the generatrix of the shell and elements which are inclined with respect to the generatrix of the shell and wherein each of said lifting elements comprises a face exposed to grinding implements contained in the rotary mill, said face including cavities with elastomeric walls, said cavities facing away from said internal wall to embed and retain the grinding implements therein under the effect of the elasticity of the elastomer.

13. Mill as claimed in claim 12, wherein each straight element is surrounded by two inclined elements and vice-versa.

14. Mill as claimed in claim 12, wherein the straight elements and the inclined elements have different radial thicknesses.

15. Mill as claimed in claim 12, wherein the thickness of the lining is constant over the entire length of the mill.

16. Mill as claimed in claim 12, wherein the thickness of the lining is higher at the outlet than at the inlet.

* * * * *